United States Patent [19]

Krohn

[11] Patent Number: 4,722,230

[45] Date of Patent: Feb. 2, 1988

[54] PRESSURE GAUGE FOR HIGH PRESSURE FLOW THROUGH DIAPHRAGM PUMP

[75] Inventor: Duane D. Krohn, West Minster, Colo.

[73] Assignee: Graco Inc., Minneapolis, Minn.

[21] Appl. No.: 869,386

[22] Filed: May 29, 1986

[51] Int. Cl.[4] ..... G01L 7/08

[52] U.S. Cl. ..... 73/756; 73/714; 417/413

[58] Field of Search ..... 73/756, 724, 718, 714; 417/413

[56] References Cited

U.S. PATENT DOCUMENTS 4,454,765 6/1984 Lodge ..... 73/756

*Primary Examiner*—Donald O. Woodiel

*Attorney, Agent, or Firm*—Douglas B. Farrow

[57] ABSTRACT

A diaphragm pump is provided for pumping paint and similar substances at relatively elevated pressures (300 psi). A pressure sensor is provided for operating the pump in order to maintain the desired pressure. The pressure sensor is located adjacently first outlet passage and is provided with a deflector which deflects the fluid in the outlet passage over the surface of the sensor diaphragm. By providing continuous flow over the face of the sensor diaphragm, paint and similar substances are prevented from drying and/or clogging thereby preventing erratic operation or failure of the device. The connecting rod which is attached to the diaphragm has an outwardly extending and downwardly tapering support surface which supports the diaphragm when under the elevated pressures of which this unit is capable of operation. An upper support member is also provided for further support.

4 Claims, 1 Drawing Figure

PRESSURE GAUGE FOR HIGH PRESSURE FLOW THROUGH DIAPHRAGM PUMP

BACKGROUND OF THE INVENTION

The use of diaphragm pumps for spray painting and other applications is, of course, well known. Such applications tend to be fairly low in pressure. Such pumps, when operated by an electrical motor, typically have a pressure sensor which provides a signal to stop and start the motor so as to maintain the desired pressure. In known units, the pressure utilizes a diaphragm which is located at the end of an elongated tube. Typically this tube is located so as to connect with an outlet passage from the pump. While such an arrangement is capable of providing workable operation, much care must be taken to properly flush and clean the unit after use. If such care is not taken, the paint or similar material may dry in the tube adjacent the sensor such that when the unit is again operated the sensor would not properly read the pressure actually being produced by the unit. The tube in which the sensor is located, in effect, produces a condition of little or not actual flow such that the clogging easily takes place.

Also, in diaphragm pumps, the connecting rod is attached to the central area of the diaphragm and no support is provided to the flexing portion of the diaphragm, except where it is clamped at its peripheral edge. When such prior art units are operated at relatively elevated pressures (such as 300 psi) the diaphragm is quite prone to failure.

SUMMARY OF THE INVENTION

The diaphragm in the pump is provided with a central area for attachment to the pump connecting rod which moves in a reciprocal direction. Between the central area which is attached to the connecting rod and the periphery of the diaphragm which is clamped into the housing of the pump is located the flexure area, that is, the area which flexes upon reciprocation of the connecting rod and central area to provide the pumping action. The connecting rod is provided with a supporting surface which contacts and provides support for the lower surface of the diaphragm when the diaphragm approaches its uppermost position, whereupon the highest pressure is obtained. The supporting surface of the connecting rod extends outwardly and downwardly from the central area and is contoured to assume the natural position and shape of the lower surface of the diaphragm were that diaphragm unsupported. The provision of this lower support provides greatly extended diaphragm life and reliability. Similarly, an upper-support surface is provided adjacent the periphery the diaphragm, it, too, being contoured to provide support on the upper surface of the diaphragm as it nears the upward end of its travel. The small relief is cut into the upper-support surface adjacent the periphery to provide greatly approved life of the diaphragm.

Except as otherwise noted in this application, the diaphragm pump is of relatively conventional construction and further reference will not be made to those parts of conventional construction.

Located in the first or outlet passage of the pump is an outlet fitting having a distal end which serves to divert flow from that passage into a second passage in which is located the sensor diaphragm of the pressure sensor. The flow is then diverted back into the outlet fitting for delivery to the paint of use. The distal end of the outlet fitting (which is threaded into the pump housing) is of such a size as to barely clear the threads in the housing so that all of the flow is diverted into the second passage over the sensor diaphragm. The sensor is one of generally conventional construction with the exception that the tube in which such sensors are generally located has been removed so that the diaphragm can be placed as close as possible to the first passage and to the distal end of the outlet member.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

FIG. 1 is a cross-sectional view showing the diaphragm support and pressure sensor of the instant invention.

DESCRIPTION OF THE PREFERRED EMBODIMENT

Figure 1:
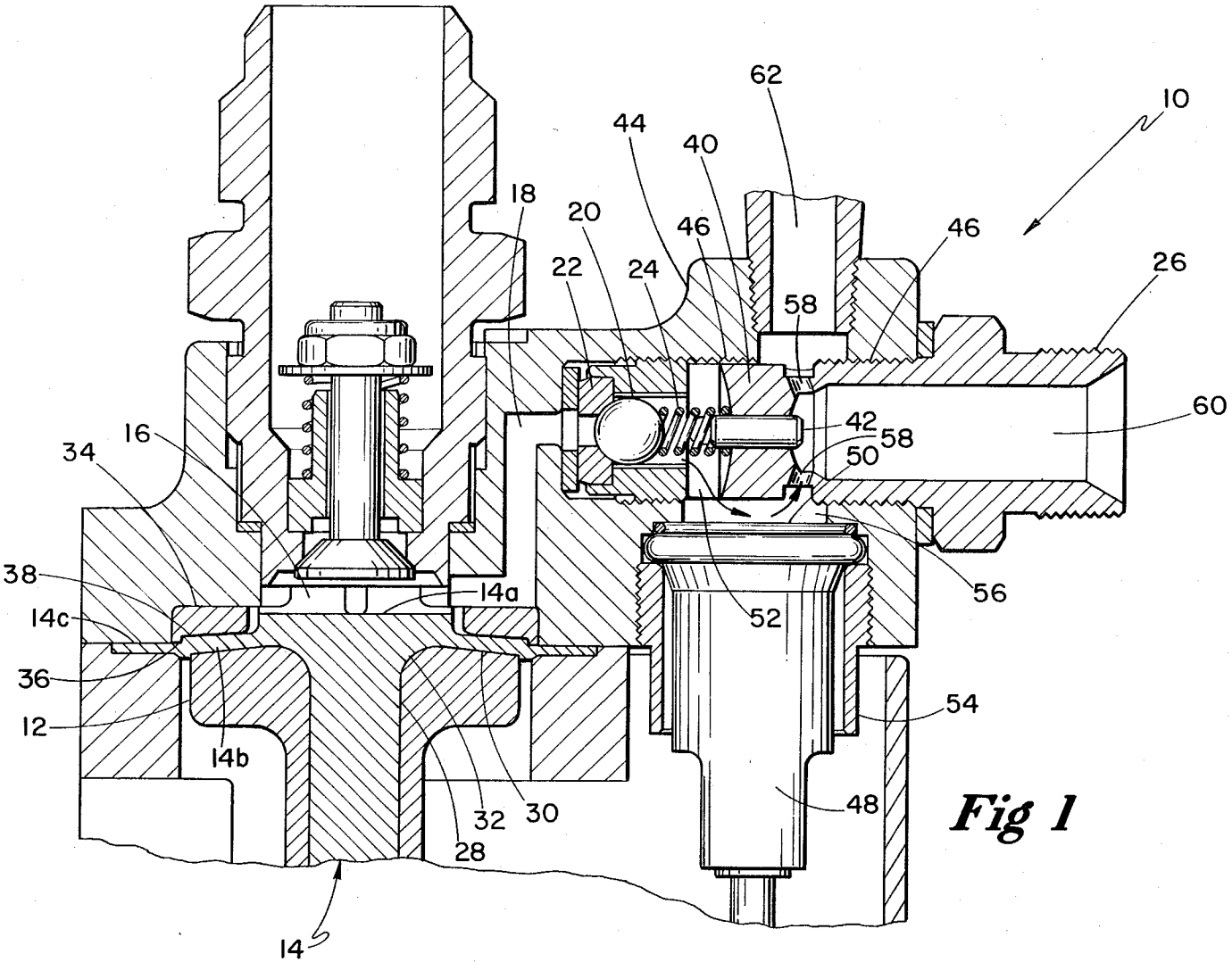

The pump, generally designated 10, of the instant invention, is a diaphragm pump and is provided with a connecting rod 12 which is attached to a diaphragm 14. Diaphragm 14 is provided with a central area **14*a* which is attached to connecting rod 12, a flexure area 14*b*, which flexes due to reciprocation of connecting rod 12 and a peripheral area, 14*c*, which is clamped between the portions of housing 44**.

A pumping chamber 16 is provided over the upper surface of diaphragm 14. An outlet passage 18 leads out of pumping chamber 16 to check ball 20 which seats on seat 22. A spring 24 urges ball 20 onto seat 22. Spring 24 seats at its other end to the distal end of outlet fitting 26.

Connecting rod 12 is provided with a bore 28 for reception of the central area **14*a* of diaphragm 14. Connecting rod 12 is provided with a top surface 30 which tapers outwardly and downwardly as it moves radially outwardly from bore 28. A rounded transition area 32 is provided between top surface 30 and bore 28**.

A diaphragm upper support member 34 is provided over the upper surface of diaphragm 14 and is provided with a surface 36 and a relief 38 immediately adjacent to peripheral edge **14*c* of diaphragm 14. Note that the contacting surface of support member 34 runs generally parallel to the support surface 30 of connecting rod 12. Both of these surfaces generally follow the contour assumed by the diaphragm in its uppermost position, that is, the position at which the pressure and stress on the diaphragm are highest. Outlet fitting 26 has a distal end 40 in which is located a pin 42 to locate spring 24. Note that the outer diameter of distal end 40 barely clears the threads 46 of housing 44**.

Sensor 48 has a diaphragm 50 thereon for sensing the pressure produced by the pump. A flow passage 52 is provided for fluid which flows past ball 20 which directs the fluid across the diaphragm 50 of sensor 48. Sensor 48 is located in a second passage in housing 44 and is held in place by a threaded collar 54. An area 56 is provided over diaphragm 50 for receiving the full flow of the output of the pump. The flow thence passes through passages 58 into outlet flow passage 60 in outlet fitting 26. A bypass or pressure relief passage 62 is provided as shown.

By providing the distal end 40 of outlet fitting 26 of such a size, all the flow pass ball check 20 is sent through passage 52 into chamber 56, thus preventing any dead spots and assuring a constant flow over the sensor diaphragm 50.

It is contemplated that various changes and modifications may be made to the diaphragm pump without departing from the spirit and scope of the invention as defined by the following claims.

What is claimed is:

1. A pressure sensing system for sensing the output pressure of a pump, said system comprising:

a first generally linear passage connected to and receiving the output of said pump;

a second passage being sustantially normal to said first passage at a junction thereto and connecting with said first passage;

a pressure sensor having a diaphragm, said sensor being located in said second passage with said sensor diaphragm adjacent to and facing said first passage; and means for deflecting the flow of fluid through said first passage across said sensor diaphragm so as to prevent the clogging and drying of fluid on said sensor diaphragm, said deflecting means comprising an outlet fitting threadedly engaged in said first passage.

2. The system of claim 1 where said first passage has a cross-section and a first end receiving fluid from said pump.

3. The system of claim 2 where said outlet fitting has a distal end located in said junction to deflect fluid across said sensor diaphragm.

4. The system of claim 3 wherein said distal end substantially fills said cross-section thereby deflecting substantially all of said fluid across said sensor diaphragm.

* * * * *